US008450947B2

(12) United States Patent
Feng

(10) Patent No.: US 8,450,947 B2
(45) **Date of Patent: *May 28, 2013**

(54) METHOD FOR DRIVING LAMP OF BACKLIGHT CONTROL CIRCUIT

(75) Inventor: Sha Feng, Shenzhen (CN)

(73) Assignees: Innocom Technology (Shenzhen) Co., Ltd, Shenzhen (CN); Chimei Innolux Corporation, Miaolin County (TW)

( * ) Notice: Subject to any disclaimer, the term of this patent is extended or adjusted under 35 U.S.C. 154(b) by 40 days.

This patent is subject to a terminal disclaimer.

(21) Appl. No.: 13/188,473

(22) Filed: Jul. 22, 2011

(65) Prior Publication Data

US 2011/0273105 A1 Nov. 10, 2011

Related U.S. Application Data

(62) Division of application No. 12/283,823, filed on Sep. 15, 2008, now Pat. No. 8,013,543.

(30) Foreign Application Priority Data

Sep. 14, 2007 (CN) ..... 2007 1 0077000

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |

(52) U.S. Cl.
USPC ..... 315/307

(58) Field of Classification Search
None
See application file for complete search history.

(56) References Cited

U.S. PATENT DOCUMENTS 8,013,543 B2 * 9/2011 Feng ..... 315/307

* cited by examiner

*Primary Examiner* — Anh Tran
(74) *Attorney, Agent, or Firm* — WPAT, PC; Justin King

(57) ABSTRACT

A backlight control circuit includes a secondary winding, a control circuit, a first circuit including a first capacitor and a first switching element, and a second circuit including a second switching element and a reactance element. A method for driving the backlight control circuit includes the control circuit switching off the first switching element, and the secondary winding outputting a startup AC voltage to the lamp. A first resonant circuit which includes the lamp, the secondary winding and the first circuit is formed, with a first resonant frequency suitable to light up the lamp. The control circuit switches on the first switching element, and the secondary winding outputs an operation AC voltage to the lamp. A second resonant circuit which includes the lamp, the secondary winding, the first and second circuit is formed, with a second resonant frequency suitable to keep the lamp lighted.

14 Claims, 4 Drawing Sheets

METHOD FOR DRIVING LAMP OF BACKLIGHT CONTROL CIRCUIT

CROSS-REFERENCE TO RELATED APPLICATION

This application is a divisional application of U.S. patent application Ser. No. 12/283,823, filed Sep. 15, 2008 and entitled "BACKLIGHT CONTROL CIRCUIT". The disclosure of such parent application is incorporated herein by reference.

BACKGROUND

1. Technical Field

The present disclosure relates to a backlight control circuit which can for example be employed in a liquid crystal display (LCD), and more particularly to a backlight control circuit defining two different resonant circuits and a method for driving the backlight control circuit.

2. Description of Related Art

LCDs have been widely used in various portable information products such as notebooks, personal digital assistants (PDAs), and video cameras, due to advantages such as portability, low power consumption, and low radiation. LCDs are poised to completely replace cathode ray tube monitors and televisions in some markets. A typical LCD includes an LCD panel, a backlight for illuminating the LCD panel, and a backlight control circuit for controlling the backlight. When a cold cathode fluorescent lamp (CCFL) is employed as the backlight, a high frequency alternating current (AC) voltage is generated by the backlight control circuit for driving the CCFL.

Referring to FIG. 4, one such backlight control circuit 100 includes a control circuit 110, a transformer 120, a lamp 130, and a capacitor 140.

The transformer 120 includes a primary winding 122 and a secondary winding 124. Two terminals of the primary winding 122 are electrically coupled to the control circuit 110. One terminal of the secondary winding 124 is grounded via the lamp 130, and the other terminal of the secondary winding 124 is grounded via the capacitor 140. The lamp 130 is a CCFL.

The control circuit 110 and the transformer 120 constitute an inverter circuit configured for providing an AC voltage to driving the lamp 130. Normally, because the AC voltage outputted from the secondary winding 124 is not a sine wave, the capacitor 140 and the secondary winding 124 need to form an resistor inductor capacitor (RLC) resonant circuit in order to provide an AC voltage with a desired sine wave for driving the lamp 130.

The RLC resonant circuit includes a fixed resonant frequency f0. When the resonant frequency f0 is equal to or close to a driving frequency of the AC voltage, an efficiency of the backlight control circuit 100 is high and energy waste is low. Thus an important quality factor of the backlight control circuit 100 is high.

The AC voltage includes a normal operation frequency f1, and a startup frequency f2 for lighting up the lamp 130 when the backlight control circuit 100 starts to work. Because the startup frequency f2 is higher than the normal operation frequency f1, the fixed resonant frequency f0 of the RLC resonant circuit can only correspond to one of the normal operation frequency f1 and the startup frequency f2. If the fixed resonant frequency f0 corresponds to the startup frequency f1, the fixed resonant frequency f0 is higher than the normal operation frequency f1. Thus the efficiency of the backlight control circuit 100 is low and energy waste is high. If the fixed resonant frequency f0 corresponds to the normal operation frequency f1, the fixed resonant frequency f0 is lower than the startup frequency f1 Thus each time the lamp 130 is lighted up, flicker is generated in the lamp 130, and the working lifetime of the lamp 130 is reduced by a decrement.

It is desired to provide a new backlight control circuit which can overcome the above-described deficiencies.

SUMMARY

A backlight control circuit includes a transformer, a control circuit, a lamp. The control circuit and the transformer form an inverter circuit to providing an AC voltage for driving the lamp. When the backlight control circuit works in a startup mode, the backlight control circuit defines a first current path including the lamp and the first current path forms a first resonant circuit. When the backlight control circuit works in an operation mode, the backlight control circuit defines a second current path including the lamp and the second current path forms a second resonant circuit. The first and second resonant circuits have different resonant frequencies from each other.

Other novel features and advantages will become more apparent from the following detailed description when taken in conjunction with the accompanying drawings.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Reference will now be made to the drawings to describe various embodiments in detail.

Figure 1:
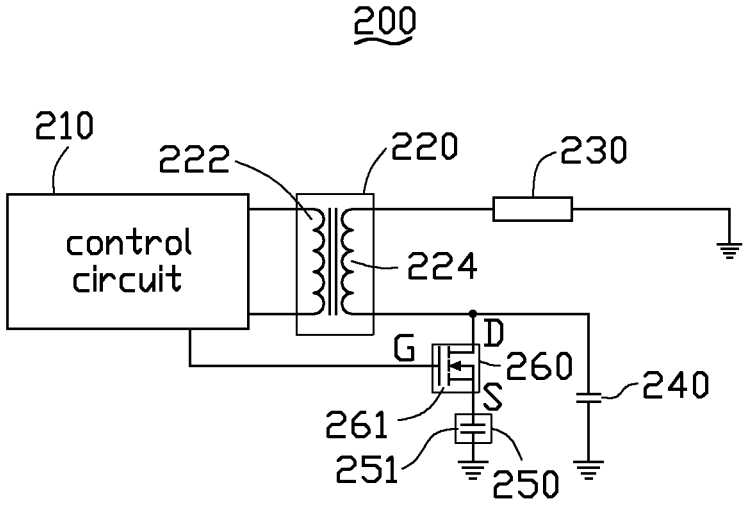
FIG. 1 is a diagram of a first embodiment of a backlight control circuit.

Referring to FIG. 1, a first embodiment of a backlight control circuit 200 includes a control circuit 210, a transformer 220, a lamp 230, a first capacitor 240, a reactance element 250, and a switching element 260.

The lamp 230 is typically a cold cathode fluorescent lamp. The control circuit 210 and the transformer 220 constitute an inverter circuit to providing an AC voltage for driving the lamp 230. The transformer 220 includes a primary winding 222 and a secondary winding 224. Two terminals of the primary winding 222 are electrically coupled to the control circuit 210. A first terminal of the secondary winding 224 is grounded via the lamp 230. A second terminal of the secondary winding 224 is grounded via the first capacitor 240.

The switching element 260 is a metal-oxide-semiconductor field-effect transistor (MOSFET) 261, which includes a gate electrode "G", a source electrode "S", and a drain electrode "D". The reactance element 250 includes a second capacitor 251. The gate electrode "G" of the MOSFET 261 is connected to the control circuit 210. The drain electrode "D"

of the MOSFET 261 is connected to the second terminal of the secondary winding 224. The source electrode "S" of the MOSFET 261 is grounded via the second capacitor 251.

When the backlight control circuit 200 works in a startup mode for initially lighting up the lamp 230, the inverter circuit formed by the control circuit 210 and the transformer 220 outputs a startup AC voltage with a first frequency f1 to light up the lamp 230. The control circuit 210 outputs a low level voltage to the gate electrode "G" of the MOSFET 261 in order to switch off the MOSFET 261. Thus the lamp 230, the secondary winding 224, and the first capacitor 240 form a first resonant circuit which has a resonant frequency f01 corresponding to or equal to the first frequency f1.

When the backlight control circuit 200 works in an operation mode for driving the lamp 230 to radiate light according to desired normal operation, the inverter circuit formed by the control circuit 210 and the transformer 220 outputs an operation AC voltage with a second frequency f2 to drive the lamp 230. The control circuit 210 outputs a high level voltage to the gate electrode "G" of the MOSFET 261 in order to switch on the MOSFET 261. Thus the lamp 230, the secondary winding 224, the first capacitor 240, the on-state MOSFET 261, and the second capacitor 251 form a second resonant circuit which has a second resonant frequency f02 corresponding to or equal to the second frequency f2.

Each of the first resonant frequency f01 and the second resonant frequency f02 can be calculated according to the following formula (1):

$$f = \frac{1}{2\pi\sqrt{LC}}. \quad (1)$$

In formula (1), "f" denotes a resonant frequency of a resonant circuit. "L" denotes a sum of inductances of the resonant circuit. "C" denotes a sum of capacitances of the resonant circuit. Because the second resonant circuit further includes the second capacitor 251 connected in parallel with the first capacitor 240, the sum of capacitances of the second resonant circuit is larger than that of the first resonant circuit. Thus the second resonant frequency f02 is less than the first resonant frequency f01. The second resonant frequency f02 can be set to be the second frequency f2 of the operation AC voltage by setting an appropriate capacitance of the second capacitor 251.

Because the backlight control circuit 200 respectively defines the first resonant circuit in the startup mode and the second resonant circuit in the operation mode, the first resonant frequency f01 of the first resonant circuit corresponds to the first frequency f1 of the startup AC voltage, and the second resonant frequency f02 of the second resonant circuit corresponds to the second frequency f2 of the operation AC voltage. Accordingly, any flicker of the lamp 230 that might otherwise occur is eliminated or depressed, and the efficiency of the backlight control circuit 200 is high.

Figure 2:
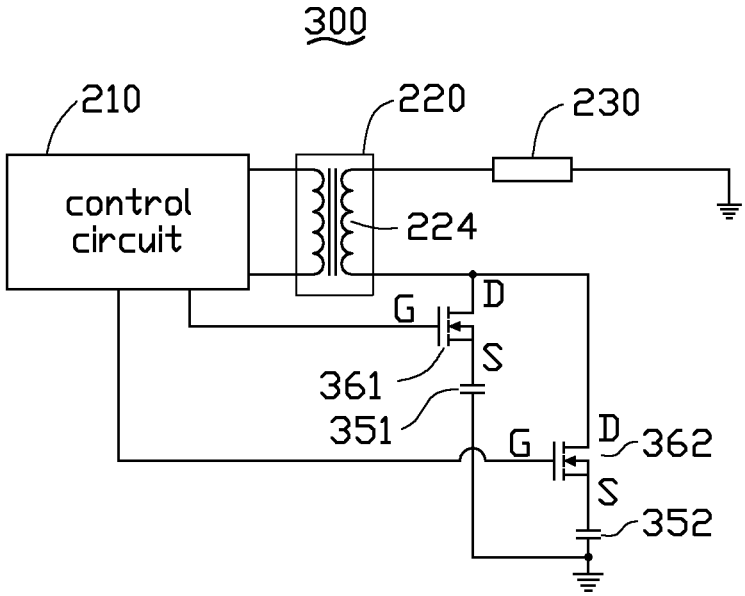
FIG. 2 is a diagram of a second embodiment of a backlight control circuit.

Referring to FIG. 2, a backlight control circuit 300 of a second embodiment is shown. The backlight control circuit 300 may be substantially similar to the backlight control circuit 200, except that the backlight control circuit 300 includes a first MOSFET 361, a second MOSFET 362, a first capacitor 351, and a reactance element such as a second capacitor 352. Gate electrodes "G" of the first and second MOSFETs 361, 362 are connected to the control circuit 210. The second terminal of the secondary winding 224 is connected to drain electrodes "D" of the first and second MOSFETs 361, 362. A source electrode "S" of the first MOSFET 361 is connected to ground via the first capacitor 351. A source electrode "S" of the second MOSFET 362 is connected to ground via the second capacitor 352. A capacitance of the first capacitor 351 is less than that of the second capacitor 352.

When the backlight control circuit 300 works in a startup mode for initially lighting up the lamp 230, the inverter circuit formed by the control circuit 210 and the transformer 220 outputs a startup AC voltage with the first frequency f1 to light up the lamp 230. The control circuit 210 switches on the first MOSFET 361 and switches off the second MOSFET 362. Thus the lamp 230, the secondary winding 224, the on-state first MOSFET 361, and the first capacitor 351 form a first resonant circuit, which has a resonant frequency f01 corresponding to or equal to the first frequency f1.

When the backlight control circuit 300 works in an operation mode for driving the lamp 230 to radiate light according to desired normal operation, the inverter circuit formed by the control circuit 210 and the transformer 220 outputs an operation AC voltage with the second frequency f2 to drive the lamp 230. The control circuit 210 switches off the first MOSFET 361 and switches on the second MOSFET 362. Thus the lamp 230, the secondary winding 224, the on-state second MOSFET 362, and the second capacitor 352 form a second resonant circuit, which has a second resonant frequency f02 corresponding to or equal to the second frequency f2.

Figure 3:
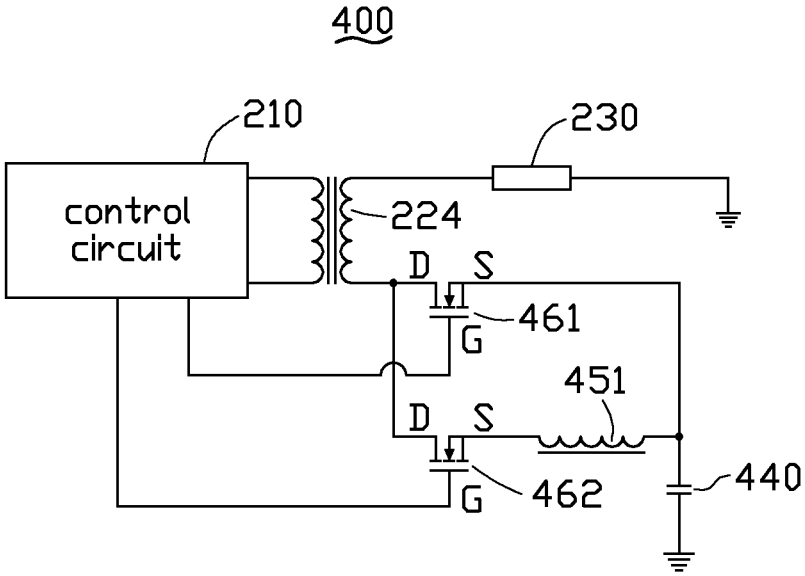
FIG. 3 is a diagram of a third embodiment of a backlight control circuit.
Figure 4:
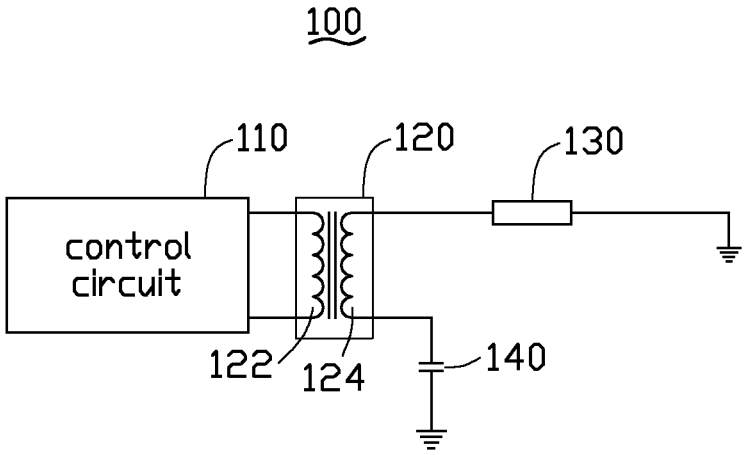
FIG. 4 (RELATED ART)
FIG. 4 is a diagram of a typical backlight control circuit.

Referring to FIG. 3, a backlight control circuit 400 of a third embodiment is shown. The backlight control circuit 400 may be substantially similar to the backlight control circuit 200 of FIG. 1, except that the backlight control circuit 400 includes a first MOSFET 461, a second MOSFET 462, a capacitor 440, and a reactance element such as an inductor 451. Gate electrodes "G" of the first and second MOSFETs 461, 462 are connected to the control circuit 210. The second terminal of the secondary winding 224 is connected to drain electrodes "D" of the first and second MOSFETs 461, 462. A source electrode "S" of the first MOSFET 461 is connected to ground via the capacitor 440. A source electrode "S" of the second MOSFET 462 is connected to ground via the inductor 451 and the capacitor 440 in series.

When the backlight control circuit 400 works in a startup mode for initially lighting up the lamp 230, the inverter circuit formed by the control circuit 210 and the transformer 220 outputs a startup AC voltage with the first frequency f1 to light up the lamp 230. The control circuit 210 switches on the first MOSFET 461 and switches off the second MOSFET 462. Thus the lamp 230, the secondary winding 224, the on-state first MOSFET 461, and the first capacitor 440 form a first resonant circuit, which has a resonant frequency f01 corresponding to or equal to the first frequency f1.

When the backlight control circuit 400 works in an operation mode for driving the lamp 230 to radiate light according to desired normal operation, the inverter circuit formed by the control circuit 210 and the transformer 220 outputs an operation AC voltage with the second frequency f2 to drive the lamp 230. The control circuit 210 switches off the first MOSFET 461 and switches on the second MOSFET 462. Thus the lamp 230, the secondary winding 224, the on-state second MOSFET 462, the inductor 451, and the capacitor 440 form a second resonant circuit, which has a second resonant frequency f02 corresponding to or equal to the second frequency f2.

In an alternative embodiment, the inductor 451 can be replaced by a capacitor. In other alternative embodiments, the capacitors 251, 351 can be replaced by inductors.

It is to be further understood that even though numerous characteristics and advantages of the present disclosure have been set out in the foregoing description, together with details of the structures and functions of the embodiments, the disclosure is illustrative only; and that changes may be made in detail, especially in matters of arrangement of parts within the principles of the invention to the full extent indicated by the broad general meaning of the terms in which the appended claims are expressed.

What is claimed is:

1. A method for driving a lamp of a backlight control circuit, the method comprising: providing a transformer, a control circuit, a first circuit, and a second circuit, the transformer comprising a primary winding and a secondary winding, an end of the secondary winding electrically connected to the lamp, the control circuit electrically connected with the primary winding of the transformer, the control circuit configured to cooperate with the transformer to provide an alternating current voltage to the lamp, the first circuit electrically connected with the other end of the secondary winding and comprising a first capacitor, the second circuit electrically connected with the other end of the secondary winding and comprising a first switching element, a reactance element and the first capacitor; the control circuit selectively switching off or on the first switching element; wherein when the control circuit switches off the first switching element, the secondary winding of the transformer outputs a startup AC voltage to the lamp, a first resonant circuit which comprises the lamp, the secondary winding of the transformer, and the first circuit is formed, the first resonant circuit having a first resonant frequency suitable to light the lamp; and when the control circuit switches on the first switching element, the secondary winding of the transformer outputs an operation AC voltage to the lamp, a second resonant circuit which comprises the lamp, the secondary winding of the transformer, the first and second circuits is formed, the second resonant circuit having a second resonant frequency suitable to keep the lamp lighted.

2. The method of claim 1, wherein the first and second resonant frequencies differ from each other.

3. The method of claim 2, wherein the second resonant frequency is less than the first resonant frequency.

4. The method of claim 1, wherein said end of the secondary winding is connected to ground via the lamp, and the other end of the secondary winding is connected to ground via the first capacitor.

5. The method of claim 4, wherein the other end of the secondary winding is also connected to ground via two conducting electrodes of the first switching element and the reactance element in series, and a control electrode of the first switching element is connected to the control circuit.

6. The method of claim 1, wherein the reactance element is a second capacitor or an inductor.

7. A method for driving a lamp of a backlight control circuit, the method comprising: providing a transformer, a control circuit, a first circuit, and a second circuit, the transformer comprising a primary winding and a secondary winding, an end of the secondary winding electrically connected to the lamp, the control circuit electrically connected with the primary winding of the transformer, the control circuit configured to cooperate with the transformer to provide an alternating current voltage to the lamp, the first circuit electrically connected with the other end of the secondary winding and comprising a first capacitor and a first switching element, the second circuit electrically connected with the other end of the secondary winding and comprising a second switching element and a reactance element; the control circuit switching on the first switching element and selectively switching on or off the second switching element; wherein when the control circuit switches on the first switching element and switches off the second switching element, the secondary winding of the transformer outputs a startup AC voltage to the lamp, a first resonant circuit which comprises the lamp, the secondary winding of the transformer, and the first circuit is formed, the first resonant circuit having a first resonant frequency suitable to light the lamp; and when the control circuit switches on the first and second switching elements, the secondary winding of the transformer outputs an operation AC voltage to the lamp, a second resonant circuit which comprises the lamp, the secondary winding of the transformer, the first and second circuit is formed, the second resonant circuit having a second resonant frequency suitable to keep the lamp lighted.

8. The method of claim 7, wherein the first and second resonant frequencies differ from each other.

9. The method of claim 8, wherein the second resonant frequency is less than the first resonant frequency.

10. The method of claim 7, wherein said end of the secondary winding is connected to ground via the lamp, the other end of the secondary winding is connected to ground via two conducting electrodes of the first switching element and the first capacitor in series, and a control electrode of the first switching element is connected to the control circuit.

11. The method of claim 10, wherein the other end of the secondary winding is also connected to ground via two conducting electrodes of the second switching element and the reactance element in series, and a control electrode of the second switching element is connected to the control circuit.

12. The method of claim 11, wherein the reactance element is a second capacitor or an inductor.

13. The method of claim 11, wherein the second circuit further comprises the first capacitor, the other end of the secondary winding is connected to ground via the two conducting electrodes of the second switching element, the reactance element and the first capacitor in series.

14. The method of claim 13, wherein the reactance element is an inductor.

* * * * *